US006830329B2

(12) United States Patent
Iwata

(10) Patent No.: US 6,830,329 B2
(45) Date of Patent: Dec. 14, 2004

(54) INK-JET RECORDING MEDIUM AND IMAGE-FORMING METHOD

(75) Inventor: Tetsu Iwata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 59 days.

(21) Appl. No.: 09/845,296

(22) Filed: May 1, 2001

(65) Prior Publication Data

US 2002/0005886 A1 Jan. 17, 2002

(30) Foreign Application Priority Data

May 2, 2000 (JP) ..... 2000-133587

(51) Int. Cl.[7] ..... B41M 5/00; B41J 2/01

(52) U.S. Cl. ..... 347/105; 156/230; 156/277; 428/32.15; 428/32.26; 428/32.34

(58) Field of Search ..... 156/230, 277; 428/32.15, 32.26, 32.34, 195; 347/105

(56) References Cited

U.S. PATENT DOCUMENTS 4,783,376 A * 11/1988 Sakaki et al. ..... 346/135.1
5,912,085 A * 6/1999 Ito et al. ..... 346/135.1
5,985,425 A * 11/1999 Tomizawa et al. ..... 347/105
6,214,458 B1 * 4/2001 Kobayashi et al. ..... 428/32.5

* cited by examiner

*Primary Examiner*—Pamela R. Schwartz
(74) *Attorney, Agent, or Firm*—Fitzpatrick, Cella, Harper & Scinto

(57) ABSTRACT

An ink-jet recording medium for use in an ink-jet image forming method in which a transparent film layer formed on a substrate as coating is placed on an ink-receiving layer of the recording medium, and then the side of the substrate is heated to transfer the transparent film layer on the ink-receiving layer, followed by peeling off the substrate to laminate the transparent film layer on the surface of the ink-receiving layer. The ink-receiving layer contains polyvinyl alcohol and a cross-linking agent.

4 Claims, 1 Drawing Sheet

INK-JET RECORDING MEDIUM AND IMAGE-FORMING METHOD

BACKGROUND OF THE INVENTION

1. Field of the Invention

This invention relates to an ink-jet recording medium and, more particularly, it relates to an ink-jet recording medium to be used in applications where a transparent film layer is formed to cover the ink-receiving layer thereof after forming an image thereon.

2. Related Background Art

Various types of recording medium to be used for forming images by ink-jet printing are known to date. Besides, recording devices (printers) using an ink-jet printing technique have developed a wide variety of applications including electronic image information outputs of computers and communication networks and those of digital cameras, digital videos and scanners, which in turn urge the development of functionally improved recording devices. As a result, there is a demand for ink-jet recording medium having various sophisticated functional features that can accommodate the functional improvements of the recording device.

For instance, there is known a technique for improving the image quality by forming a laminate comprising an ink-receiving layer and a transparent film layer formed on the ink-receiving layer for the purpose of improving the glossiness and smoothness of the surface of the formed image as well as the maximum density of the image in order to achieve image quality comparable to that of silver salt photography and multi-color printing. The lamination process is utilized for improving not only the image quality but also the light fastness, the water fastness and the ozone fastness of the formed image to maintain high image quality for a prolonged period of time.

With a known technique that can be used for the lamination process, a transparent film layer with which a heat resistant substrate is coated is heated from the side of the heat resistant substrate so as to be transferred onto the ink-receiving layer of a recording medium and subsequently the heat resistant substrate is peeled off.

When the binder of the ink-receiving layer contains polyvinyl alcohol as a principle ingredient and the lamination process is conducted immediately after an ink-jet printing operation, a swell can appear between the substrate of the ink-jet recording medium and the ink-receiving layer form thereon while the substrate is heated. Additionally, when the heat resistant substrate is peeled off after the transfer of the transparent film layer, the ink-receiving layer can also be peeled off together with the heat resistant substrate. Therefore, there is a demand for a lamination process that is free from the above identified problems.

SUMMARY OF THE INVENTION

In view of the above described circumstances, it is therefore an object of the present invention to provide an ink-jet recording medium suitable for easy and excellent laminate formation and free from the problems such as swell arising between the ink-receiving layer and the substrate of the ink-jet recording medium immediately after an ink-jet printing operation, and peeling off of the ink-receiving layer at the time of peeling off a heat resistant substrate after the transfer of a transparent film layer. More specifically, an object of the present invention is to provide an ink-jet recording medium having a novel ink-receiving layer to which a transparent film layer is transferred in the lamination process without any problem.

As a result of the intensive research efforts for solving the above identified problems, the inventors of the present invention found that the tight contact between the ink-receiving layer and the substrate of the ink-jet recording medium is maintained and swells between them are prevented, when polyvinyl alcohol is used as a principal ingredient of a binder for fixing inorganic particles that are used to improve ink absorptivity, and the polyvinyl alcohol molecules are cross-linked by the heat-induced action of a cross-linking agent contained therein during the process of transferring the transparent film layer onto the ink-receiving layer after the ink-jet printing operation. The inventors of the present invention also found that both the phenomenon of swell arising between the substrate of the ink-jet recording medium and the ink-receiving layer and that of peeled-off of the ink-receiving layer arising in the operation of peeling off the heat resistant substrate that carries the transparent film layer on the surface thereof are eliminated by the use of such a binder.

Thus, according to the invention, there is provided an ink-jet recording medium for use in an ink-jet image forming method in which a transparent film layer formed on a substrate as coating is placed on an ink-receiving layer of the recording medium, and then the side of the substrate is heated to transfer the transparent film layer on the ink-receiving layer, followed by peeling off the substrate to laminate the transparent film layer on the surface of the ink-receiving layer, the ink-receiving layer containing polyvinyl alcohol and a cross-linking agent.

In another aspect of the invention, there is also provided an ink-jet printed article comprising the ink-jet recording medium according to the invention having an image formed on the ink-receiving layer thereof, the transparent film layer being formed on the ink-receiving layer as coating.

In still another aspect of the invention, there is also provided an image forming method comprising the steps of forming an image on the ink-receiving layer of the ink-jet recording medium by ink-jet and coating the ink-receiving layer with the transparent film layer by heating.

When an ink-jet recording medium according to the invention is subjected to a lamination process by heating and transferring the transparent film layer on the surface of the ink-receiving layer containing the above ingredients after an ink-jet printing operation, the obtained printed article maintains a high image quality particularly in terms of the glossiness and smoothness of the image surface and the image density as well as the fastness including the light fastness, the water fastness and the ozone fastness. Additionally, no problem occurs if the lamination process of heating and transferring the transparent film layer is conducted immediately after the ink-jet printing operation, so that an ink-jet recording medium according to the invention can reduce the time required for the entire process from the ink-jet printing operation to the completion of the lamination process. Therefore, an ink-jet printing process using an ink-jet recording medium according to the invention can enjoy a high printing speed.

DETAILED DESCRIPTION OF THE PREFERRED EMBODIMENTS

Like conventional ink-jet recording mediums, an ink-jet recording medium according to the invention comprises at least an ink-receiving layer formed on a substrate used for ink-jet printing. Such an ink-jet recording medium is typically used for forming an image thereon by ink-jet printing followed by subjecting the printed surface thereof to a lamination process. More specifically, an ink-jet printing operation is conducted on the surface of the ink-receiving layer and subsequently a transparent film layer is laminated on the printed surface to coat the latter, thereby producing a finished printed article.

Figure 1:
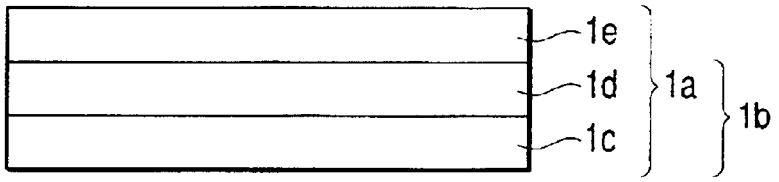
FIG. 1 is a schematic cross sectional view of a printed article produced by forming an image on an ink-jet recording medium according to the invention which has been subjected to a lamination process.

FIG. 1 is a schematic cross sectional view of a finished printed article produced by using an ink-jet recording medium according to the invention. As shown, the printed article comprises an ink-jet recording medium composed of a substrate 1*c* and an ink-receiving layer 1*d* for absorbing ink provided on the substrate 1*c*, and a transparent film layer 1*e* formed thereon to produce a multilayer structure.

The substrate of the ink-jet recording medium may be made of a plastic film of polyethylene, polyethyleneterephthalate (PET) or the like, or a sheet of wood free paper, coat paper, laminate paper or the like.

The ink-receiving layer contains a binder whose principle ingredient is polyvinyl alcohol. Polyvinyl alcohol can suitably be used as the binder of the ink-receiving layer from the viewpoint of ink absorptivity and economy because it can be purchased at low cost. Polyvinyl alcohol can be obtained by saponifying the ester thereof that has been synthetically produced. For the purpose of the invention, polyvinyl alcohol having a saponification degree of 78% to 89% can most suitably be used for the ink-receiving layer. The binder of the ink-receiving layer may contain urethane or the like. Preferably, the ink-receiving layer contains not less than 30 weight % of polyvinyl alcohol.

Preferably, the ink-receiving layer is formed by uniformly mixing porous inorganic particles with the polyvinyl alcohol contained in the binder as a principal ingredient to further improve ink absorptivity. Porous inorganic particles that can be used for the purpose of the invention include fine particles of silica, alumina, magnesium carbonate, calcium carbonate, mixed crystal of silica and alumina or magnesium or the like. The use of silica is particularly advantageous from the economical point of view. Additionally, in view of the fact that printed articles are ultimately thrown away as waste and incinerated in most cases, the use of silica is further advantageous because it does not harm the environment if it is incinerated. While the average particle diameter of all the porous inorganic particles may be selected as a function of the film thickness of the ink-receiving layer and the size of ink dots to be used for printing, it is preferably one third or less of the film thickness of the ink-receiving layer. On the other hand, however, too small average particle diameter can prevent ink from being quickly absorbed by the ink-receiving layer. Therefore, the average particle diameter of the porous inorganic particles is normally between 3 and 7 μm, preferably between 5 and 7 μm. Preferably, porous particles of silica formed by agglomerating fine particles of silica are used for the purpose of the invention. The average diameter of silica agglomerates is normally between 3 and 7 μm, preferably between 5 and 7 μm from the viewpoint of increasing the ink absorption rate. Agglomerated silica particles are commercially available. Those products of silica agglomerates include Finesil X-60 (tradename, available from Tokuyama Co., Ltd.) and Mizukasil P-50 (tradename, available from Mizusawa Kagaku Kogyo Co., Ltd.).

After uniformly mixing the porous inorganic particles of silica with the binder containing polyvinyl alcohol as a principal ingredient, they are applied to the surface of the substrate to a predetermined film thickness to produce an ink-receiving layer. The ink-receiving layer contains porous inorganic particles in an amount of 100 to 300 parts by weight, preferably 120 to 200 parts by weight, based on 100 parts by weight of polyvinyl alcohol in the binder. The ink absorptivity of the ink-receiving layer can be remarkably improved when porous inorganic particles are added to the above defined ratio.

Preferably, the degree of polymerization of polyvinyl alcohol to be used for the binder is between 1,500 and 3,600 from the viewpoint of applicability and the strength of the resulting film.

Various additives such as dispersants, fluorescent dyes, pH adjusters, lubricants and surfactants that can be added to the ink-receiving layer of conventional recording mediums may also be appropriately and selectively added to the ink-receiving layer of an ink-jet recording medium according to the invention whenever necessary. In view of the fact that the ink-receiving layer of an ink-jet recording medium according to the invention contains porous inorganic particles and various additives, the polyvinyl alcohol content of the ink-receiving layer is preferably not higher than 70 weight %, more preferably not higher than 50 weight %. In other words, the content of inorganic porous particles and that of various additives need to be so selected that the polyvinyl alcohol content of the ink-receiving layer is found to be between 30 and 70 weight %, preferably between 35 and 50 weight %.

While the film thickness of the ink-receiving layer of an ink-jet recording medium according to the invention can be appropriately selected depending on objects to be printed and the type of ink to be used, it is preferably between 15 and 60 μm, more preferably between 35 and 60 μm, if the ink-jet recording medium is to be used for forming fine images. The ink-receiving layer can satisfactorily absorb ink in the form of a dot and minimize the bleeding of ink dots when the film thickness of the ink-receiving layer is set within the above defined range.

According to the invention, a cross-linking agent is added to the ink-receiving layer in order to cross-link polymer molecules of polyvinyl alcohol that are used as a binder after an ink-jet printing operation. Preferably, a compound that reacts with hydroxy groups of polyvinyl alcohol in a heated condition to cross-link polymer molecules of polyvinyl alcohol is used as the cross-link agent. Preferable compounds as cross-linking agents for the purpose of the invention include isocyanate compounds and epoxy compounds. By using such cross-linking agent, polymer molecules of polyvinyl alcohol are cross-linked to prevent any swell between the ink-receiving layer and the substrate during the process of laminating a transparent film while applying heat.

Preferably, the cross-linking reaction does not practically proceed at temperatures used for storing an ink-jet recording medium according to the invention before use but proceed satisfactorily at heating temperatures of a lamination process which will be discussed hereinafter. More specifically, it is preferable that the cross-linking reaction is hardly observable in the temperature range between room temperature (20° C.) and 120° C. but significantly proceeds when the temperature exceeds 120° C. or so. Such cross-linking agents include isocyanate compounds including aromatic diisocyanates such as tolylenediisocyanate (TDI), 4,4'-diphenylmethanediisocynate (MDI), xylenediisocyanate (XDI) and metaxylylenediisocyanate (MXDI), aliphatic diisocyanates such as hexamethylenediisocyanate (HDI) and alicyclic diisocyanates such as isophoronediisocyanate (IPDI) and hydrogenated MDI, and epoxy compounds including polyamide epoxy resin and epichlorohydrin. The reactivity of the above cross-linking reaction depends on the mixing ratio of polyvinyl alcohol and the cross-linking agent. For the purpose of the invention, if a polymerization degree and a saponification degree of polyvinyl alcohol are selectively set between 1,500 and 3,000 and between 78% and 89% respectively, the cross-linking agent is added in an amount of 0.5 to 5 equivalents, preferably 1 to 3 equivalents, of —N═C═O group in the case of an isocyanate compound, or in an amount of 1 to 10 equivalents, preferably 2 to 6 equivalents, of epoxy ring in the case of an epoxy compound, based on 100 equivalents of OH group of polyvinyl alcohol, depending on the type of the cross-linking agent. In other words, the cross-linking agent is added in an amount of 1 to 10 parts by weight, preferably 2 to 5 parts by weight based on 100 parts by weight of polyvinyl alcohol, although it depends on the molecular weight of the cross-linking agent.

A disperse liquid used for forming the ink-receiving layer is prepared by adding a cross-linking agent to polyvinyl alcohol in a predetermined proportion along with porous inorganic particles such as silica particles and other additives, and mixing them to produce a uniform mixture. The disperse liquid is then applied onto the substrate to form the ink-receiving layer. Techniques that can be used for applying the disperse liquid to the substrate include roll coating, rod bar coating, slot die coating or the like.

On the other hand, materials that can be used for the transparent film layer to be formed on the ink-receiving layer to produce a finished printed article include acryl, vinyl chloride, vinyl acetate and styrene prepared in the form of a light transmitting film. The transparent film layer is provided as a coating layer formed on a heat resistant substrate and used in a lamination process, which will be described below.

Figure 2:
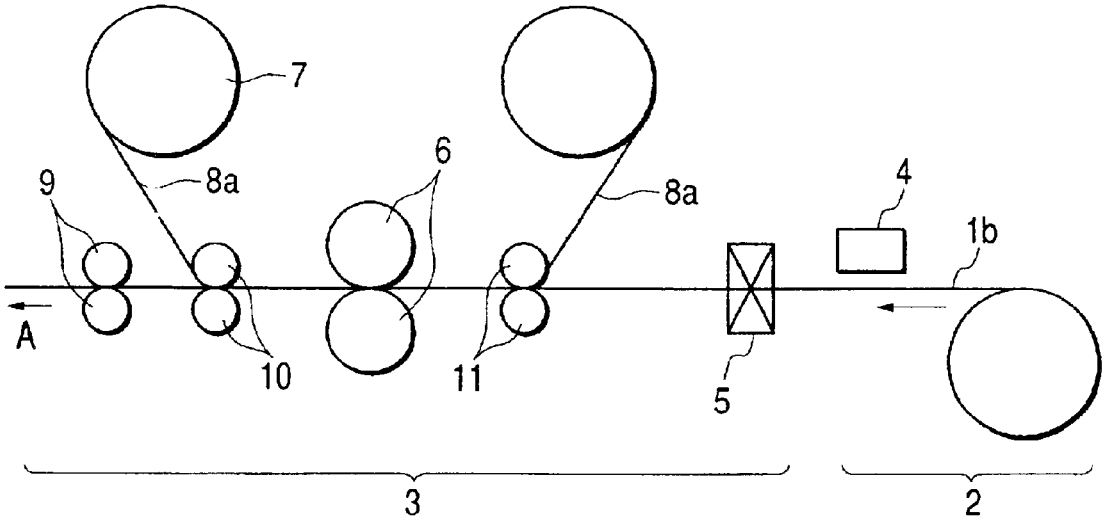
FIG. 2 is a schematic illustration of an image forming apparatus that can be used for producing a printed article by forming an image on an ink-jet recording medium according to the invention, which has been subjected to a lamination process, showing principle parts thereof including an ink-jet recording section and a lamination process section.

Now, the process of transferring and laminating a transparent film layer on an ink-jet recording medium according to the invention will be described. FIG. 2 is a schematic illustration of an image forming apparatus that can be used sequentially for the operation of ink-jet recording (printing and image formation) using an ink-jet recording medium and the subsequent operation of transferring and laminating the transparent film layer on the ink-jet recording medium.

The apparatus of FIG. 2 is adapted to use as an ink-jet recording medium an ink receiving member (recording medium) wound around a feed spool. Referring to FIG. 2, an ink-jet recording section 2 is arranged for the upstream part for the purpose of carrying out an ink-jet recording operation on an ink receiving member 1*b*. For the downstream part is arranged a lamination process section 3 for performing a lamination process in which a transparent film layer 1*e* is formed on the ink receiving member 1*b* that has been subjected to an ink-jet recording operation. Note that the ink receiving member 1*b* corresponds to the substrate 1*c* and the ink-receiving layer 1*d* as shown in FIG. 1.

The upstream ink-jet recording section 2 is provided with an ink-jet recording head 4. The ink-jet recording head 4 is adapted to apply ink according to image information so that an image is formed on the ink-receiving layer 1*d* of the ink receiving member 1*b* being fed from the feed spool.

After the image formation, the part of the ink receiving member 1*b* where the image is formed is cut to a predetermined size (length) by means of a cutter 5 and then automatically moved to the downstream lamination process section 3. Meanwhile, the transparent film layer 1*e* to be used for the lamination process is also wound around a spool in the form of a laminate member 8*a* comprising a heat resistant substrate 8*b* and the transparent film layer 1*e* as shown in FIG. 3.

The laminate member 8*a* fed to the lamination process section 3 is made to pass through a pair of rollers 6 with the transparent film layer 1*e* thereof facing the ink-receiving layer 1*d* of the cut ink receiving member (recording medium) 1*b*. While the laminate member 8*a* and the ink receiving member (recording medium) 1*b* pass through the pair of rollers 6, they are appropriately pressed under heating to transfer the transparent film layer 1*e* onto the ink-receiving layer 1*d*.

As a result of the heating and pressing treatment, the transparent film layer 1*e* is forcibly bonded onto the ink-receiving layer 1*d*. Thereafter, only the heat resistant substrate 8*b* is pulled by a take-up device 7 to peel off the transparent film layer 1*e* forcibly bonded to the ink-receiving layer 1*d* away from the heat resistant substrate 8*b* to separate them from each other. As a result, a printed article 1*a* carrying an image as shown in FIG. 1 is obtained. Referring to FIG. 2, the printed article 1*a* is delivered in the direction of arrow A by means of a pair of delivery rollers 9. In FIG. 2, reference numerals 10 and 11 also denote respective pairs of rollers.

Figure 3:
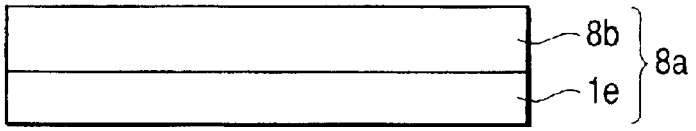
FIG. 3 is a schematic cross sectional view of a laminate that can be used to produce a printed article by forming an image on an ink-jet recording medium according to the invention, which has been subjected to a lamination process.

Referring now to FIG. 3, the heat resistant substrate 8*b* of the laminate member 8*a* needs to be made of a material that would not be deformed when it is heated under pressure. Therefore, the material of the heat resistant substrate 8*b* needs to be such that the substrate 8*b* can maintain its profile when it is heated under pressure in order to thermally bond the transparent film layer 1*e* onto the ink-receiving layer 1*d* and can be easily peeled off from the transparent film layer 1*e* in the stage subsequent to the transfer of the transparent film layer 1*e* onto the ink-receiving layer 1*d*. Thus, the heat resistant substrate 8*b* is typically made of a film or sheet of polyethyleneterephthalate (PET), polyethylenenaphtalate (PEN), polyphenylenesulfide (PPS) or polyethersulfone (PES). The thickness of the heat resistant substrate 8*b* is set in such a way that the substrate 8*b* can be easily transferred and taken up and would not be unnecessarily expanded in the lamination process. Typically, the thickness of the heat resistant substrate 8*b* is between 20 and 50 $\mu$m.

As pointed out earlier, the transparent film layer 1*e* is made of a film of a light transmitting material such as acryl, vinyl chloride, vinyl acetate or styrene, which are all thermoplastic resins, so that the transparent film layer 1*e* can be firmly bonded to the ink-receiving layer 1*d* by heating it under pressure at temperatures that allow the heat resistant substrate 8*b* to stably maintain its profile. Additionally, the material of the transparent film layer 1*e* needs to be such that it quickly loses its plasticity when cooled after the transfer without leaving any tack. Thus, desirably, an appropriate material having a glass transition temperature between 0° C. and 120° C. should be selected for the transparent film layer 1*e* depending on the temperature to which it is heated in the lamination process. The above listed thermoplastic resin materials including acryl, vinyl chloride, vinyl acetate or styrene, which satisfy the requirement for the glass transition temperature, are among those that can preferably be used for the transparent film layer 1*e*.

The transparent film layer 1*e* may be made of composite film obtained by laminating two or more thin films. For instance, the transparent film layer 1*e* may comprise an upper layer having a low glass transition temperature between −90° C. and 50° C. and serving as an adhesive layer and an upper layer having a high glass transition temperature between 0° C. and 120° C. and serving as a tack-free layer. With such an arrangement, a laminate coat that has more suitable properties can be obtained.

Additionally, if at least one of the component layers of the transparent film layer 1*e* is made of a film containing an ultraviolet ray absorbing polymer in which an ultraviolet ray absorbing agent is chemically coupled with a thermoplastic resin, the printed article obtained as a result of a lamination process will have a high degree of light fastness and its ultraviolet ray blocking ability will hardly be degraded with time.

The transparent film layer 1*e* to be formed on the heat resistant substrate as coating can be formed by preparing a coating solution of thermoplastic resin mixed, if necessary, with a solvent, applying the coating solution onto the heat resistant substrate to a predetermined film thickness and drying the solution. Techniques that can be used for applying the coating solution to the substrate include roll coating, rod bar coating, slot die coating and microgravure coating. The film thickness of the transparent film layer is preferably between 5 and 50 μm, although it may depend on the type of the resin used for it.

An ink-jet recording medium according to the invention is used in combination with a transparent film layer (laminate member) formed on the heat resistant substrate as coating to produce a finished printed article.

EXAMPLES

Now, the structure of an ink-jet recording medium according to the invention and the steps for manufacturing the same will be described in greater detail by way of examples. While these examples may show the best modes of carrying out the invention, the present invention is by no means limited thereto.

Example 1

An epoxy compound was selected as a cross-linking agent for polyvinyl alcohol and a specimen of ink-jet recording medium was prepared by way of the following steps. For the ink-receiving layer of the ink-jet recording medium, powdery silica was selected for porous inorganic particles and dispersed in the polyvinyl alcohol of the binder, to which the epoxy type cross-linking agent was added to a predetermined proportion. Additionally, a transparent film comprising two layers of an ultraviolet ray absorbing polymer layer and an acryl type thermoplastic resin layer was selected for the transparent film layer to be laminated on the recording medium, and a polyethyleneterephthalate film is coated therewith to produce a laminate member.

Ink-jet Recording Medium

Polyvinyl alcohol (PVA235: tradename, available from Kuraray Co., Ltd.; degree of polymerization 3,500, degree of saponification 88) was heated and dissolved in ion-exchanged water to obtain a 10 wt % solution. Then, 60 parts by weight of aqueous solution of polyvinyl alcohol, 9 parts by weight of silica (Finesil X-60: tradename, available from Tokuyama Co., Ltd.) and 31 parts by weight of ion-exchanged water were mixed and stirred to obtain a disperse liquid.

Then, 0.3 parts by weight of an epoxy type cross-linking agent (Sumirez Resin 675: tradename, available from Sumitomo Chemical Co., Ltd.) were added to 99.7 parts by weight of the disperse liquid and mixed to produce a uniform mixture solution to be used for forming the ink-receiving layer.

Wood free paper weighing 105 g/m$^2$ (115 μm thick) was selected for the substrate. The solution for forming an ink-receiving layer was applied onto the wood free paper by slot die coating using a slot die coater at a rate good for producing an ink-receiving layer having a thickness of 50 μm after drying. The solution was then dried to produce a solid ink-receiving layer to obtain an ink-jet recording medium.

Laminate Member

A polyethyleneterephthalate film (38 μm thick) was used for the heat resistant substrate. An ultraviolet ray absorbing polymer (PUVA-30M: tradename, available from Otsuka Kagaku) was applied onto the polyethyleneterephthalate film by microgravure coating at a rate good for producing a film thickness of 5 μm after drying. Subsequently, an acryl emulsion (Acryl-type Emulsion 2706: tradename, available from Nissin Kagaku) was applied thereon at a rate good for producing a film thickness of 10 μm after drying. As a result, the intended laminate member was obtained.

Printed Article

An image was formed on the obtained recording medium by means of an ink-jet printer (BJF8500: tradename, available from Canon). Thereafter, the transparent film layer of the laminate member was brought into contact with the ink-receiving layer and a steel roll of ϕ80 mm heated to 140° C. and a rubber roll of ϕ50 mm also heated to 140° C. were arranged respectively at the side of the transparent film layer and at the side of the heat resistant substrate to heat the ink-jet recording medium and the laminate member therebetween under pressure with a nip load of 120N and a feeding rate of 10 mm/sec in order to bond the transparent film layer and the ink-receiving layer together. Immediately after passing through the rolls, the heat resistant substrate of the laminate member was peeled off to produce a printed article.

Example 2

In this example, an isocyanate type compound was selected as a cross-linking agent for polyvinyl alcohol and a specimen of ink-jet recording medium was prepared by the following the process as described below. A laminate member which is the same as that of Example 1 was used also in this example.

Ink-jet Recording Medium

The process as described in Example 1 was used to prepare the same disperse solution as in Example 1.

Then, 0.3 parts by weight of an isocyanate type cross-linking agent (Bayhydur3100: tradename, available from Sumitomo Bayer Urethane) were added to 99.7 parts by weight of the disperse liquid and mixed to produce a uniform mixture solution to be used for forming the ink-receiving layer.

This solution for forming the ink-receiving layer was applied to the same substrate to the same thickness as in Example 1 to produce an ink-jet recording medium.

A printed article was prepared by using this ink-jet recording medium and the same laminate member under the same printing conditions as in Example 1.

Comparative Example 1

A specimen of ink-jet recording medium was prepared in a manner as described above for Example 1 except that no cross-linking agent was added to polyvinyl alcohol.

A printed article was prepared by using this ink-jet recording medium and the same laminate member under the same printing conditions as in Example 1.

Table 1 below shows the evaluated quality of the printed article prepared in each of Examples 1 and 2 and Comparative Example 1. No difference could be observed among the three specimens in terms of the condition of the printed image in the intermediary stage before subjected to a lamination process, namely in terms of the ink absorptivity of the ink-receiving layer and the dot resolution of ink. However, as shown in Table 1, a clear difference was observed between Examples 1 and 2 and Comparative Example 1 in terms of the quality of the printed article obtained after the lamination process.

The printed articles of Example 1 and 2 in which a cross-linking agent had been added to polyvinyl alcohol have a desired level of image quality, whereas that of Comparative Example 1 in which no cross-linking agent had been added to polyvinyl alcohol has a swell in part of the finished product obtained after the lamination process.

TABLE 1

| | Example 1 | Example 2 | Comparative Example 1 |
|---|---|---|---|
| Printing performance of ink-receiving layer | good | good | good |
| Image quality after lamination process | good | good | poor (swell occurred) |

As clearly seen from Table 1, a printed article obtained by using an ink-jet recording medium according to the invention, the surface of which has been subjected to a lamination process, has an excellent image quality particularly in terms of the glossiness and smoothness of the image surface and the image density as well as the fastness such as the light fastness, the water fastness and the ozone fastness. Additionally, an ink-jet recording medium according to the invention can reduce the time required for obtaining an printed article subjected to a lamination process, namely the time for the entire process from the ink-jet printing operation to the completion of the lamination process. Therefore, the number of printed articles that can be produced per unit time can be increased and hence an ink-jet printing operation using an ink-jet recording medium according to the invention can enjoy a high printing speed.

What is claimed is:

1. An ink-jet recording medium that is used in combination with a laminate member, the recording medium comprising a base sheet and an ink-receiving layer on the base sheet, the ink-receiving layer being the outermost surface of the recording medium, for use in an ink-jet image forming method in which a transparent film layer formed on a substrate as coating is placed on the ink-receiving layer on which recording has been conducted, and then the side of said substrate is heated to transfer said transparent film layer on said ink-receiving layer, followed by peeling off said substrate to laminate said transparent film layer on the surface of said ink receiving layer, said ink-receiving layer containing polyvinyl alcohol, porous inorganic silica particles having an average particle diameter between 5 $\mu$m and 7 $\mu$m, and an epoxy compound as a cross-linking agent, the epoxy compound being in the ink-receiving layer in an uncross-linked state, wherein the content of the polyvinyl alcohol in said ink-receiving layer is not lower than 30 weight %, the content of porous inorganic silica particles in said ink-receiving layer is 100 to 300 parts by weight based on 100 parts by weight of polyvinyl alcohol and the content of the epoxy compound is such that 1 to 10 equivalents of epoxy ring is contained based on 100 equivalents of OH group of the polyvinyl alcohol.

2. The ink-jet recording medium according to claim 1, wherein the degree of saponification of said polyvinyl alcohol is between 78% and 89%.

3. The ink-jet recording medium according to claim 1, wherein the average degree of polymerization of said polyvinyl alcohol is between 1,500 and 3,600.

4. An image forming method comprising the steps of forming an image on the ink-receiving layer of the ink-jet recording medium according to claim 1 by ink-jet and coating said ink-receiving layer with the transparent film layer by heating.

* * * * *

UNITED STATES PATENT AND TRADEMARK OFFICE

CERTIFICATE OF CORRECTION

PATENT NO. : 6,830,329 B2
DATED : December 14, 2004
INVENTOR(S) : Tetsu Iwata

It is certified that error appears in the above-identified patent and that said Letters Patent is hereby corrected as shown below:

Title page,
Item [54], Title, "INK-JET RECORDING MEDIUM AND IMAGE-FORMING METHOD" should read -- INK-JET RECORDING MEDIUM, PRINTED ARTICLE AND IMAGE-FORMING METHOD --.

Column 2,
Line 17, "peeled-off" should read -- peeling-off --.

Column 4,
Line 62, "agent" should read -- agents --.

Column 5,
Line 9, "diphenylmethanediisocynate" should read -- diphenylmethanediisocyanate --.

Signed and Sealed this

Twenty-first Day of February, 2006

JON W. DUDAS
*Director of the United States Patent and Trademark Office*